US008112848B2

(12) United States Patent
Takazawa et al.

(10) Patent No.: US 8,112,848 B2
(45) **Date of Patent: *Feb. 14, 2012**

(54) SLIDER FOR A FLUID TIGHT SLIDE FASTENER

(75) Inventors: Shigeyoshi Takazawa, Runcorn (GB); Morimasa Yoneoka, Prarolo (IT)

(73) Assignee: YKK Corporation, Tokyo (JP)

( * ) Notice: Subject to any disclaimer, the term of this patent is extended or adjusted under 35 U.S.C. 154(b) by 518 days.

This patent is subject to a terminal disclaimer.

(21) Appl. No.: 11/901,411

(22) Filed: Sep. 17, 2007

(65) Prior Publication Data

US 2008/0066270 A1 Mar. 20, 2008

(30) Foreign Application Priority Data

Sep. 18, 2006 (GB) ..... 0618329.7

(51) Int. Cl.
*A44B 19/10* (2006.01)

(52) U.S. Cl. ..... 24/415; 24/430; 24/427; 24/428; 24/389

(58) Field of Classification Search ..... 24/415, 24/389, 403, 392, 401, 391, 417, 428, 427, 24/431, 416, 585.1, 585.11, 585.12, 430
See application file for complete search history.

(56) References Cited

U.S. PATENT DOCUMENTS

| | | | | |
|---|---|---|---|---|
| 2,296,468 | A | 9/1942 | Feist | |
| 3,111,738 | A * | 11/1963 | Bair | 24/389 |
| 3,668,745 | A | 6/1972 | Krupp | |
| 3,818,549 | A * | 6/1974 | Moertel | 24/428 |
| 4,055,876 | A * | 11/1977 | Ackermann et al. | 24/421 |
| 4,409,705 | A * | 10/1983 | Yuunaga | 24/415 |
| 4,562,622 | A * | 1/1986 | Takabatake | 24/427 |
| 5,517,733 | A * | 5/1996 | Chao | 24/427 |
| 6,092,266 | A * | 7/2000 | Lee | 24/389 |
| 6,343,408 | B1 * | 2/2002 | Neugebauer | 24/389 |
| 6,490,770 | B1 * | 12/2002 | Matsuda et al. | 24/428 |
| 6,497,014 | B2 * | 12/2002 | Neugebauer | 24/389 |
| 6,530,132 | B2 * | 3/2003 | Yamagishi et al. | 24/427 |
| 6,622,351 | B2 * | 9/2003 | Takasawa | 24/415 |
| 7,059,024 | B2 * | 6/2006 | Yoneoka et al. | 24/391 |
| 7,257,868 | B2 * | 8/2007 | Yoneshima | 24/415 |
| 2002/0017010 | A1 * | 2/2002 | Neugebauer | 24/391 |
| 2007/0107171 | A1 * | 5/2007 | Kojima | 24/415 |

FOREIGN PATENT DOCUMENTS

| | | |
|---|---|---|
| EP | 1 057 423 | 12/2000 |
| EP | 1 175 842 | 1/2002 |
| EP | 1 201 144 | 5/2002 |
| EP | 1 430 804 | 6/2004 |
| EP | 1 614 364 | 1/2006 |

OTHER PUBLICATIONS

European Search Report for EP Application No. 07 25 3671.7-2314 dated Jan. 4, 2008.

* cited by examiner

*Primary Examiner* — Robert J Sandy
*Assistant Examiner* — Rowland D Do
(74) *Attorney, Agent, or Firm* — Alston & Bird LLP

(57) ABSTRACT

A slider for a fluid tight slide fastener that has upper and lower plates joined together by a guide post. A guide plate is formed on the guide post to cooperate with the upper and lower plates, to guide the coupling elements and sealing lips of the slide fastener into engagement in conjunction with side flanges on the upper and lower plates. The slider is integrally formed, such as by die casting or moulding. To facilitate moulding the guide plate may be thickened at its leading end and provided with a tapered edge, and connected to the upper plate by a web at its trailing end.

8 Claims, 7 Drawing Sheets

SLIDER FOR A FLUID TIGHT SLIDE FASTENER

CROSS-REFERENCE TO RELATED APPLICATIONS

The entire disclosure of British patent application No. GB0618329.7 filed on Sep. 18, 2006 is incorporated herein by reference in its entirety.

BACKGROUND

1. Field of the Invention

This invention relates to a slider for a fluid tight fastener.

2. Description of the Related Art

Examples of such a fluid tight fastener are described in EP-A-1057423 and EP-A-1175842. In such a fluid tight fastener, a coil like continuous coupling member is sewn onto a tape surface near an edge of the tape. The other surface of the tape is coated with a fluid proof layer which extends beyond the edge of the tape to form a sealing lip. When the coupling members of adjacent tapes are engaged, the sealing lips of the fluid proof layers abut to form a seal. Such fasteners can provide a reasonably good seal against liquids or gasses, depending on various factors such as the design of the sealing lips of the fluid proof layers, the extent to which they are urged together by the coupled elements and the extent of flexing of the fastener in use.

The slider shown in EP-A-1057423 and EP-A-1175842 incorporates a guide plate or "guide flange" in the form of a thin blade which projects from the wedge which joins the upper and lower plates of the slider. This guide plate extends between the outer ends of the coupling elements and the sealing lips. Thus the guide plate creates upper and lower paths within the slider and serves to ensure more accurate alignment of the coupling elements as they are brought together and enables greater pressure to be exerted on the sealing lips whilst keeping them aligned.

In practice, the slider shown in EP-A-1057423 and EP-A-1175842 has been made of three parts, with the guide plate being formed separately and sandwiched between the upper and lower plates and guide posts. This adds significantly to the cost of the production process.

SUMMARY

Thus a first aspect of the present invention provides a slider for a fluid tight slide fastener, the slider having upper and lower plates joined together by a guide post and a guide plate formed on the guide post to cooperate with the upper and lower plates to guide the coupling elements and sealing lips of the slide fastener, wherein the slider is integrally formed. In particular the slider may be die cast or moulded as a single, integral member of metal or plastics material. By integrally forming the slider we are able to strengthen the slider, and in particular in the region between the upper plate and the guide plate where the slider parts are subject to greater separation forces as the slider is pulled along the fastener to urge the sealing lips together. This substantially reduces the cost of the production process and also leads to an improvement in product quality because of the avoidance of any misalignment or other errors which may arise in an assembly process.

A difficulty with the prior art slider design was the use of a relatively thin guide plate which extended a relatively long distance from the guide post and so was unsupported. This could not be reliably moulded as an integral part of the slider.

In another feature of the invention, the trailing portion of the guide plate is joined to the upper plate by a web which extends from the guide post. The web may extend to the trailing edge of the guide plate.

In another feature of the invention, the forward part of the guide plate is thickened relative to the trailing end. The outer edge of the thickened part may be chamfered.

The underside of the guide plate may be substantially flat, forming with the lower plate a guide channel for the coupling elements. The underside of the trailing end may be thickened where it joins the guide post.

In one embodiment, the trailing end of the upper plate has downwardly projecting guide flanges extending perpendicularly from the edge of the upper plate. In another embodiment, the guide flanges may be wedge shaped in cross section, to form a guide channel which is narrowed at its upper region, near the upper plate.

Other aspects and preferred features of the invention will be apparent from the following description and the accompanying claims.

The invention will be further described by way of example with reference to the accompanying drawings in which:

DETAILED DESCRIPTION OF THE INVENTION

Figure 1:
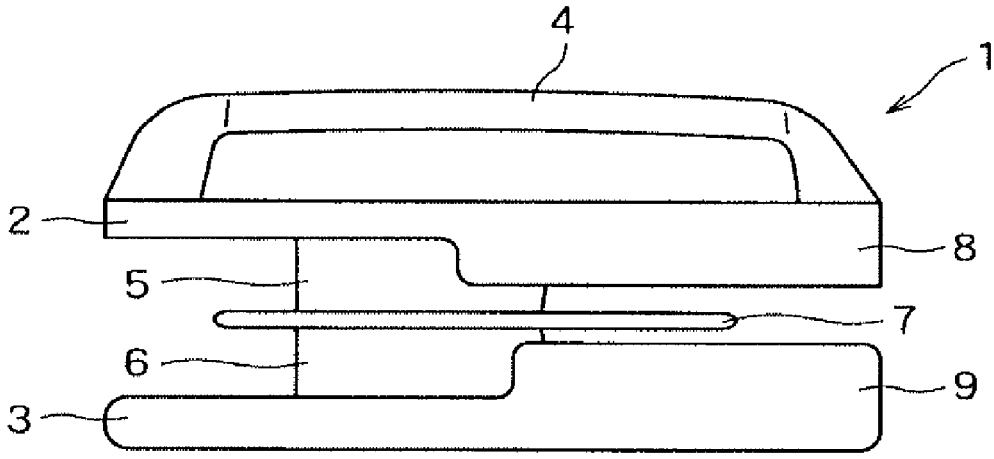
FIG. 1 (Prior Art)
FIG. 1 is a side view of a prior art slider.
Figure 2:
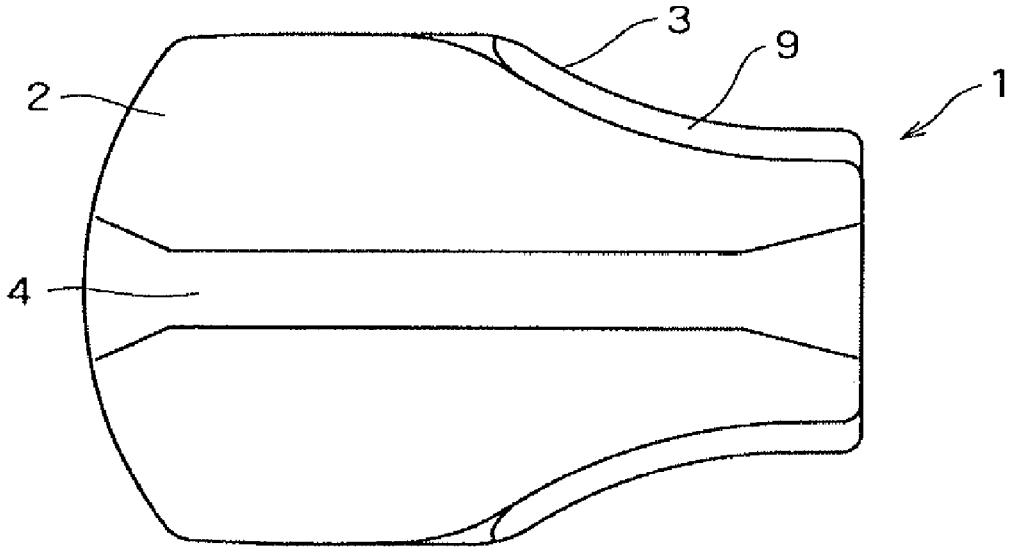
FIG. 2 (Prior Art)
FIG. 2 is a plan view of the slider of FIG. 1.
Figure 3:
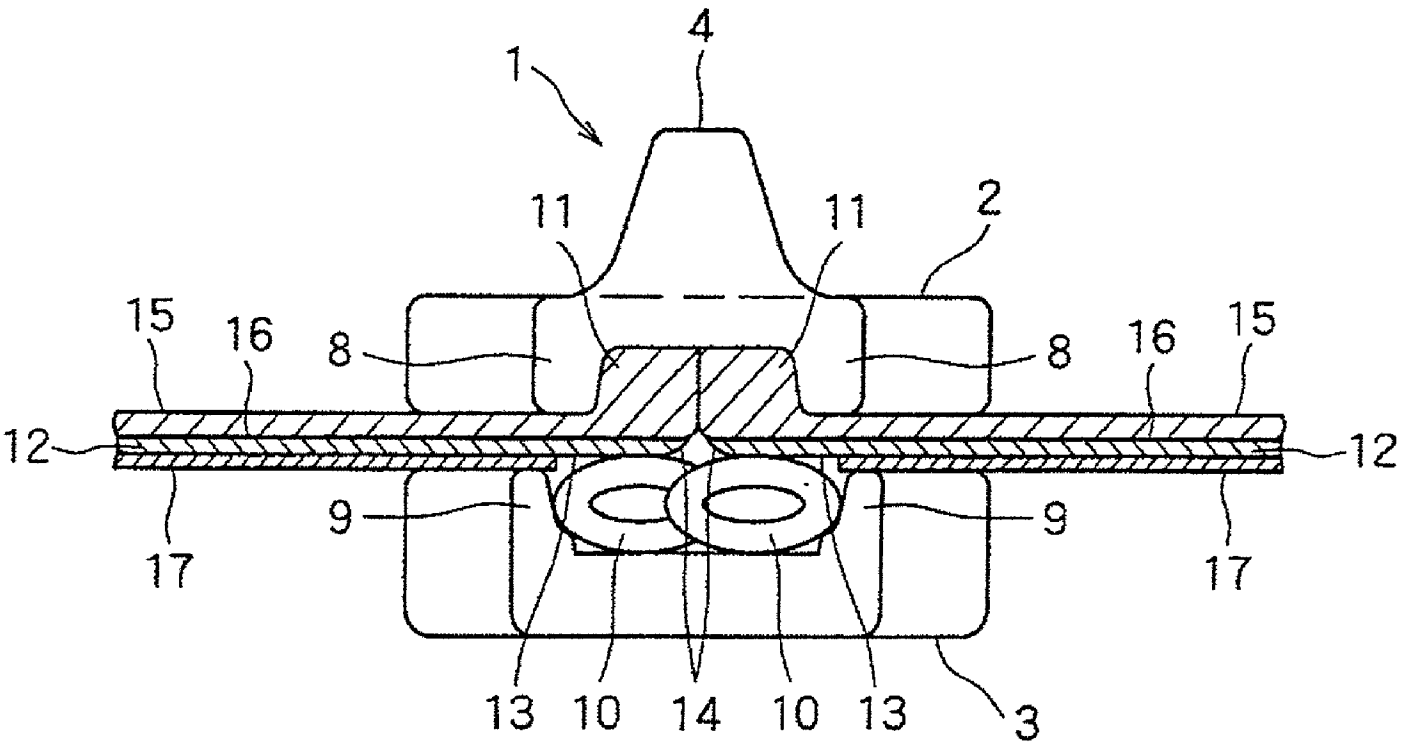
FIG. 3 (Prior Art)
FIG. 3 is an end view of the slider of FIGS. 1 and 2, on a slider fastener.

Referring to FIGS. 1 and 2, these show a side view and plan view of a prior art slider 1. Slider 1 has upper and lower plates 2, 3 with a bridge 4 formed on the upper plate 2 for receiving a slider puller (not shown). Upper and lower guide post halves 5, 6 depend from the upper and lower plates and sandwich a guide plate 7 between them. As seen in FIG. 3, side flanges 8, 9 depend from the left and right side edges of the upper and lower plates 2, 3 at the trailing ends of the plates so as to extend longitudinally of the slider 1. When the slider 1 moves forward, the side flanges 8, 9 serve to couple the coupling elements 10 and urge sealing lips 11 of the fastener into abutting engagement with each other. As also illustrated in FIG. 3, the fluid tight slide fastener comprises tapes 12 with coil like coupling elements 10 mounted on one surface 13 near the outer edge 14 of the respective tapes. A fluid proof coating 15, such as a rubber, elastomer or thermoplastics material, is provided on the other, upper surface 16. The coating 15 has sealing lips 11 formed integrally therewith, which sealing lips 11 are guided by the guide plate 7 and upper plate 2 into an abutting, sealing position as the fastener elements 10 are coupled together. A reinforcing tape 17 is provided on the underneath surface of the tapes 12.

Figure 4:
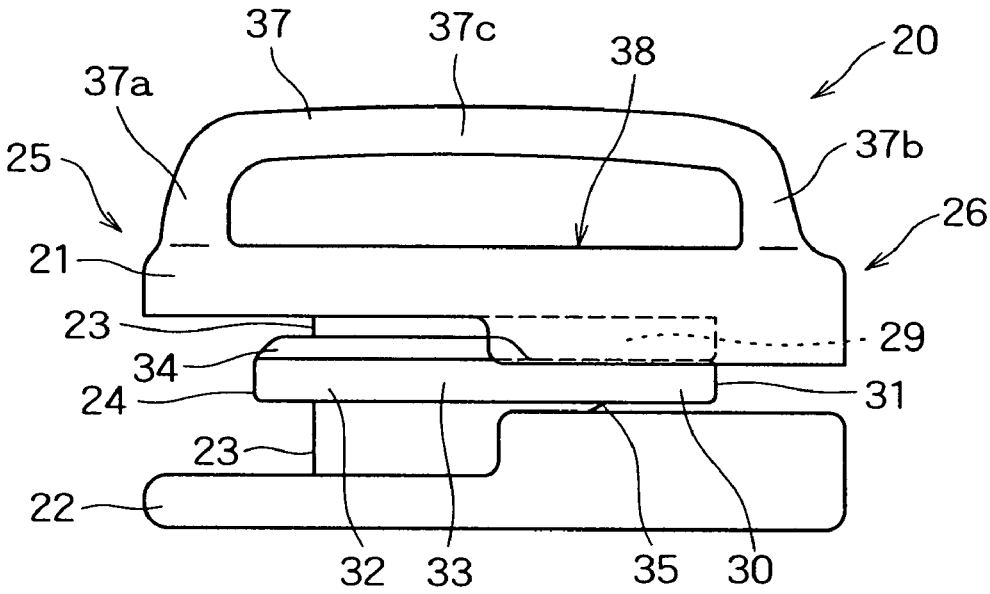
FIG. 4 is a side view of a slider forming a first embodiment of the invention.
Figure 5:
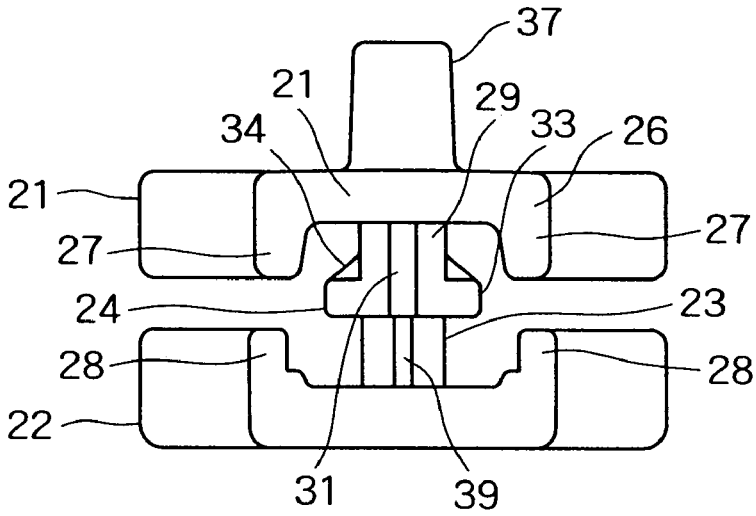
FIG. 5 is a trailing end view of the slider of FIG. 4.

Referring to FIGS. 4 and 5, these drawings show a slider 20 in accordance with the invention for a fluid tight slide fastener of the type described above. The slider has parallel upper and lower guide plates 21, 22, and a guide post 23 joining both the guide plates 21, 22. In addition, a guide plate 24 is disposed between the upper plate 21 and the lower plate 22 and spaced from the upper and lower plates 21, 22, respectively. The guide plate 24 is joined with the guide post 23. As shown in FIG. 4, the guide plate 24 extends out from the guide post 23 towards the forward and trailing ends 25, 26 of the slider 20. As shown in FIG. 5, the guide plate 24 also extends toward opposed left and right sides of the guide post 23. The upper and lower guide plates 21, 22, guide post 23 and guide plate 24 are integrally formed, that is formed of a single unitary piece. They may be formed of metal by die-casting or of plastics by moulding, for example.

A bridge 37 for attaching a puller (not shown) is also integrally formed on the upper surface 38 of the upper plate 21. The bridge 37 includes a front leg 37*a* mounted on the front end 25 of the slider 1, a rear leg 37*b* mounted on the rear end 26 of the slider 1 and a bridge proper 37*c* connecting the front and rear legs 37*a*, 37*b* at their respective upper ends. Other structures for attaching a puller may be used, as known in the art.

Figure 7:
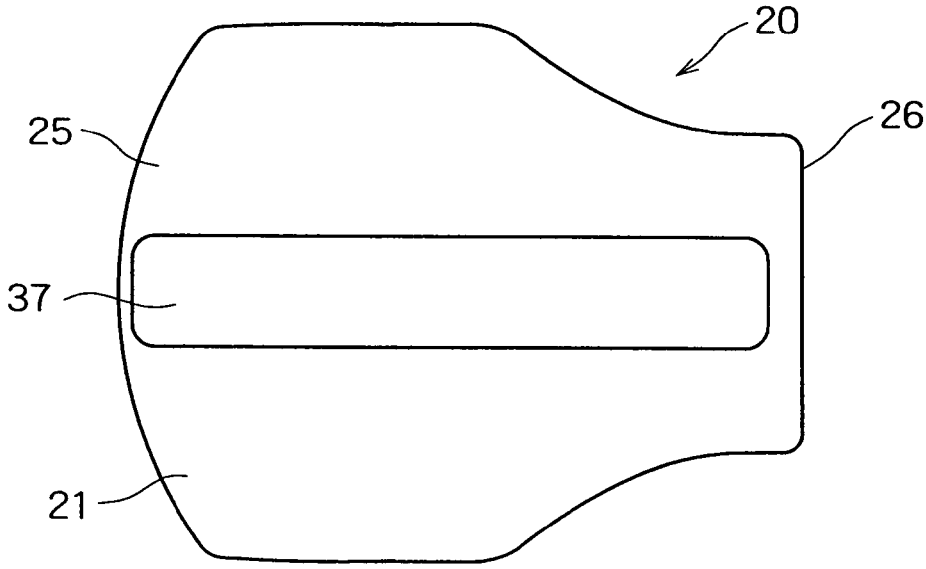
FIG. 7 is a plan view of the slider of FIG. 4.

The upper and lower plates 21, 22 are of generally the same outline or shape, as viewed in a plan. As seen in FIG. 7, both the plates 21, 22 taper towards the trailing end 26. Upper and lower side flanges 27, 28 depend from the left and right opposed sides of the respective upper and lower plates 21, 22 over the tapering portion of the plates 21, 22. The upper flange 27 is formed so as to project from the upper plate 21 toward the lower plate 22 and to stand at a right angle relative to the upper plate 21, while the lower flange 28 is formed so as to project from the lower plate 22 toward the upper plate 21 and to stand at a right angle relative to the lower plate 22. As known in the art, the lower flange 28 serves to urge the coupling elements 10 of the opposed tapes 12 toward each other and into engagement when the slider 20 moves forward. On the other hand, the upper flanges 27 serve to urge the sealing lips 11 toward each other and into abutting engagement with each other, when the slider 20 moves forward. Although the lips 11 would be pulled together as the coupling elements 10 are engaged, the side flanges 27 will reduce the strain on the coupling elements 10 and their connection to the tapes 12, and also serve to ensure consistent orientation of the sealing lips 11.

The guide plate 24 is a particular feature of this invention. Forming the upper and lower plates 21, 22 guide post 23 and guide plate 24 as an integral unit serves to strengthen the slider 20. We also enhance the strength by increasing the thickness of the guide plate 24 and providing a greater mating area with the upper plate 21.

Figure 10:
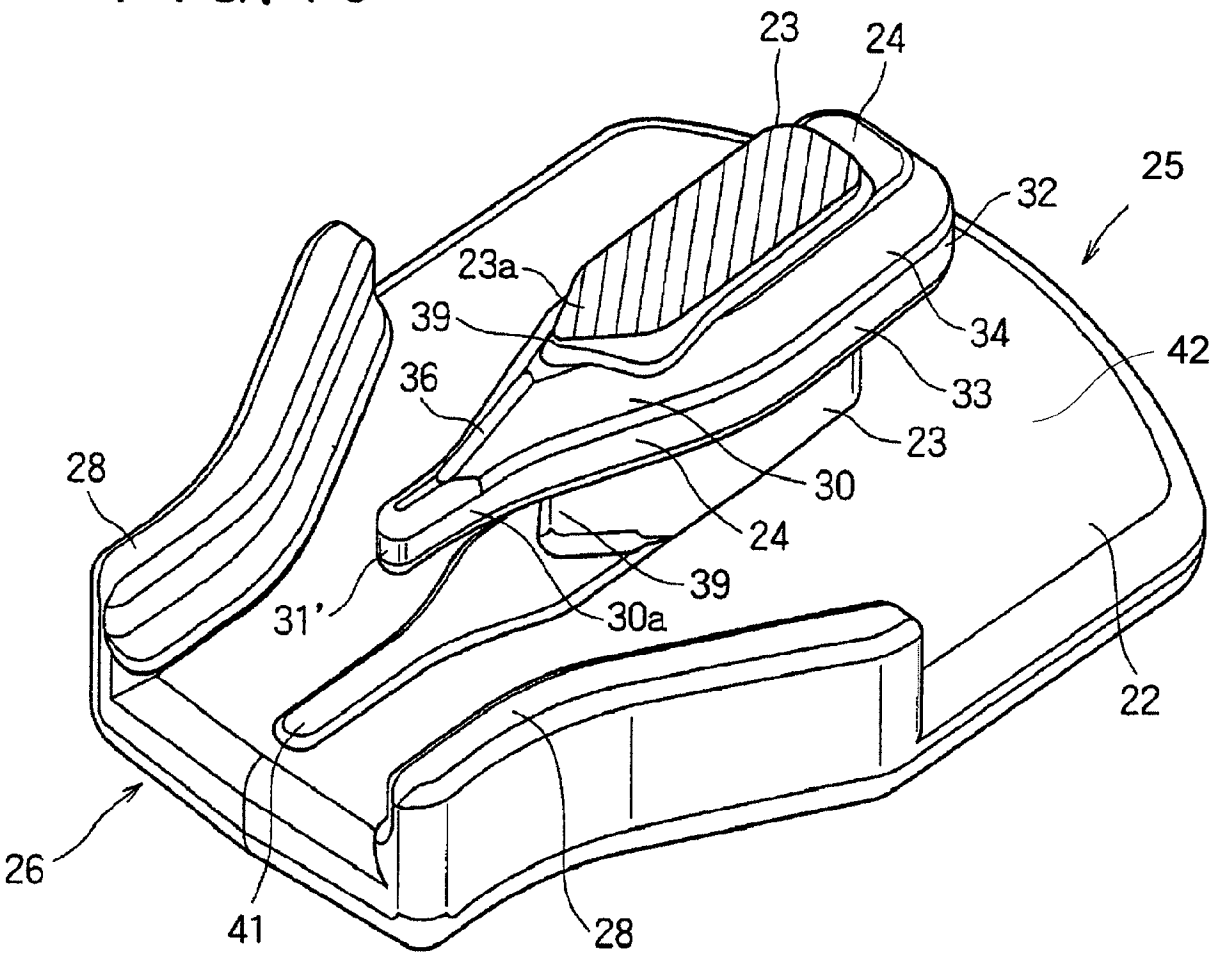
FIG. 10 is a perspective view of the embodiment of FIG. 8 with an upper plate cut away.

As better seen in FIG. 10, the guide post 23 has a generally rectangular cross-section with a tapered end 23*a*, ending in a trailing edge 39 of the guide post 23.

Figure 6:
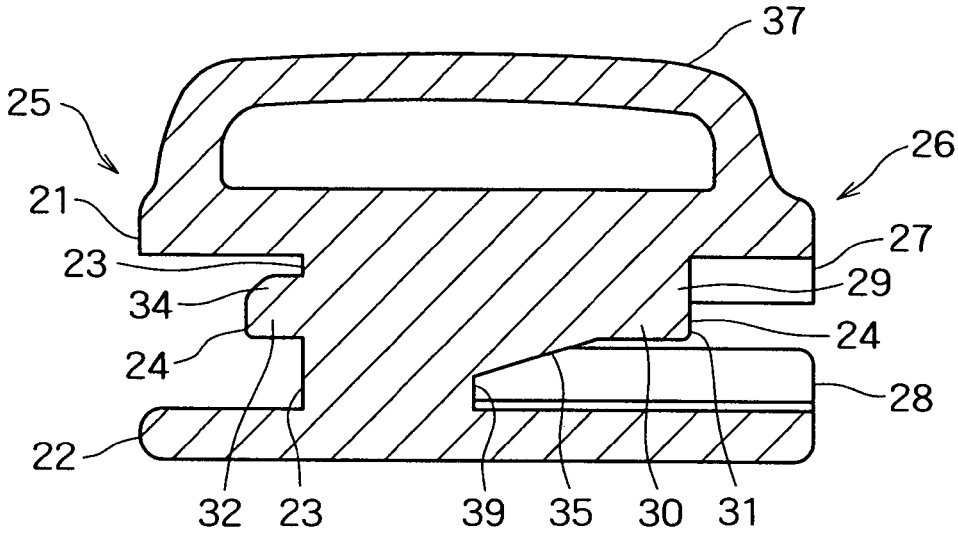
FIG. 6 is a longitudinal cross-section of the slider of FIG. 4.

Referring particularly to FIGS. 5 and 6, a web 29 joins the trailing portion 30 of the guide plate 24 to the upper plate 21. Web 29 tapers in thickness from the guide post 23 to the trailing edge 31 of the guide plate 24, to provide a smooth transition path for the sealing lips as they are urged together.

In the embodiment shown, the web 29 extends from the guide post 23 to the trailing edge 31 of the guide plate 24. However, the web 29 may stop short of the trailing edge 31.

The guide plate 24 includes a forward portion 32 extending from the guide post 23 toward the forward end 25 of the slider 20, a tailing portion 30 extending from the guide post 23 toward the tailing end 26 of the slider 20 and a side portion 33 extending from the guide post 23 sideways or laterally of the slider 20

The forward portion 32 and the side portion 33 of the guide plate 24 are thickened, being thicker than the trailing portion 30 over a region extending approximately from the trailing edge 39 of the guide post 23 toward the forward end 25 of the slider 20. The outer edge of the forward portion 32 and the side portion 33 is tapered in thickness, and has a chamfer 34. The chamfer 34 is formed on the upper surface of the guide plate 24 and is disposed so as to face the upper plate 21. A fillet 35 is provided on the under side of the trailing portion 30 of the guide plate 24 at the junction with the trailing edge 39 of the guide post 23. The fillet 35 extends from the trailing edge 39 of the guide post 23 toward the trailing edge 31 of the guide plate 24 and is tapered in thickness in that direction.

Figure 8:
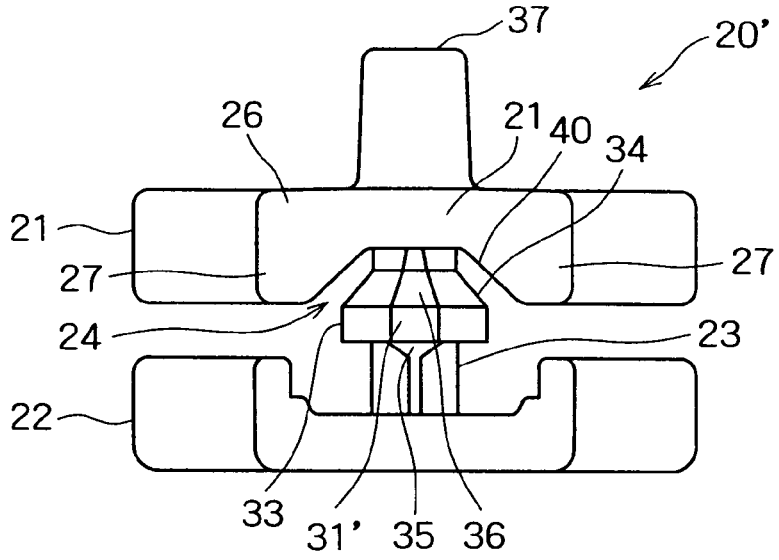
FIG. 8 is a trailing end view of a second embodiment of the invention.
Figure 9:
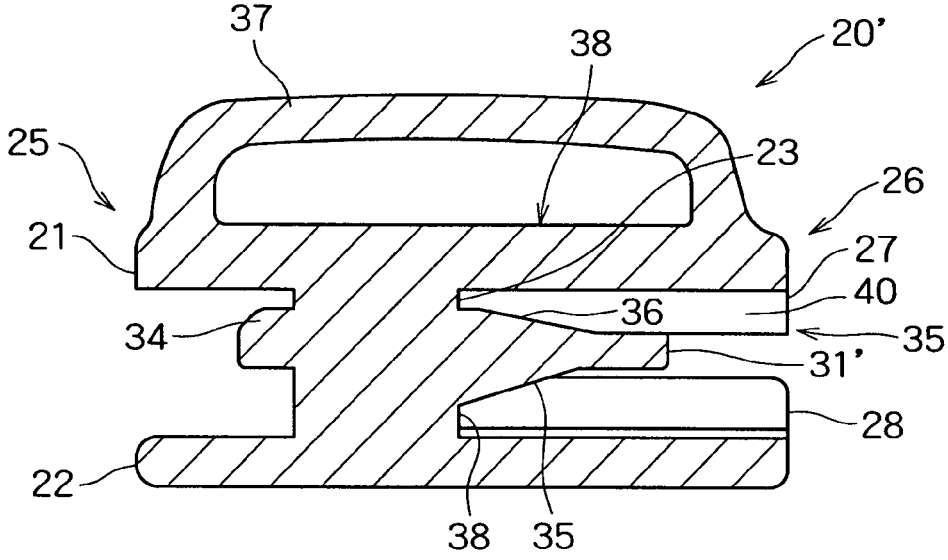
FIG. 9 is a longitudinal cross-section view through the embodiment of FIG. 8.

FIGS. 8 to 10 show a second embodiment of the invention, similar to the embodiment of FIGS. 4 to 7 and like parts are given like reference numerals. In this embodiment, the web 29 of the previous embodiment is omitted. However, the thickness of the forward portion 32 is continued rearward past the trailing edge 39 of the guide post 23 and tapers down in thickness to a trailing edge 31' which is thinner than the forward portion 32 to thus form on the trailing portion 30 of the guide plate 24 a trailing surface 36 which slants down toward the trailing edge 31' of the guide plate 24. The opposed lateral sides of the trailing surface 36 merge in the chamfer 34 provided on the forward and side portions 32, 33. On the trailing portion 30 is formed a sticklike nose portion 30a extending from the trailing surface 36 toward the trailing end 26 of the slider 20.

Also shown in this second embodiment is the provision of fillets 40 between the upper side flanges 27 and the upper plate 21 to form an outlet mouth 35 at the trailing end 26 of the slider 20 which is tapered inwardly from the plane of the fastener coating layer 15 (the bottom edge of the side flange 27) towards the upper plate 23. The fillets serve to guide the sealing lips of the slide fastener and may be shaped to match the upper surface of the sealing lips 11.

Also seen in FIG. 10 is a shallow platform 41 on the upper surface 42 of the lower plate 22. The shallow platform 41 serves to help orient in a suitable direction the posture that the coiled coupling elements 10 assume when coupled, as known in the art.

Figure 11:
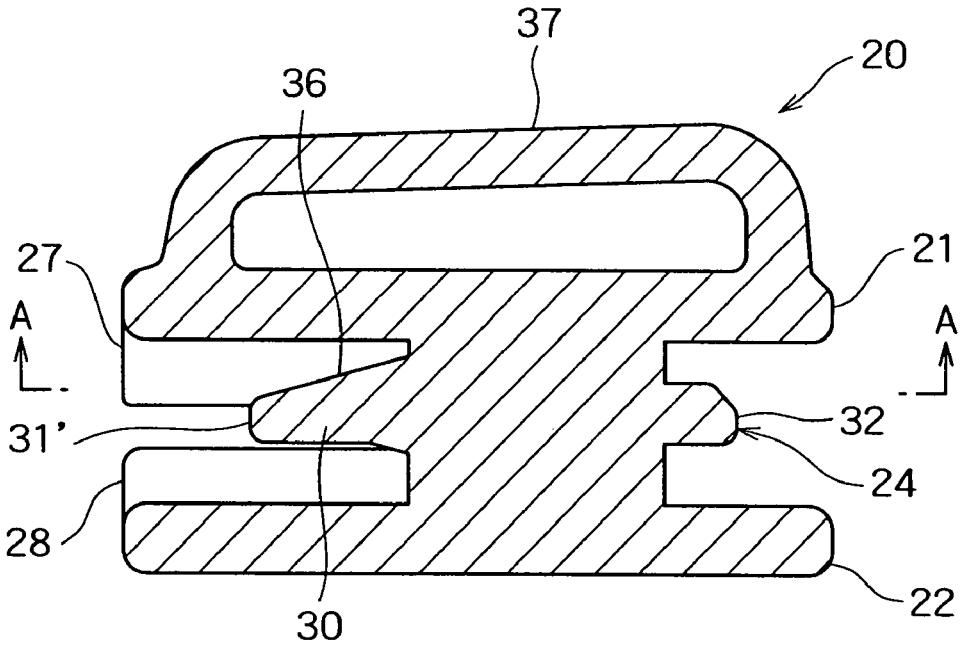
FIG. 11 is a longitudinal cross-sectional view of a slider according to a third embodiment of the present invention.
Figure 12:
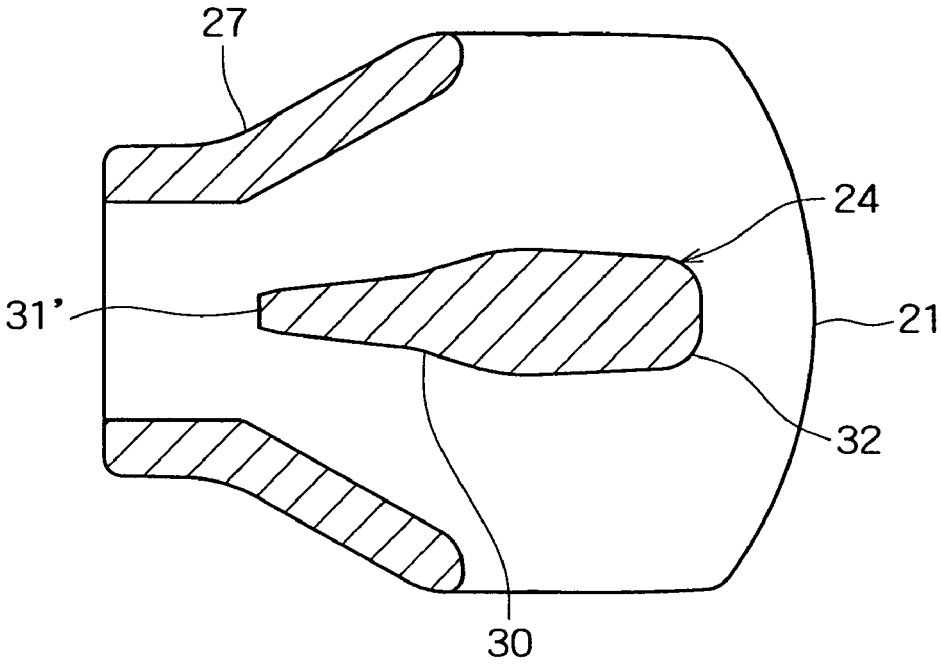
FIG. 12 is a cross-sectional view taken on line A-A of FIG. 11.

FIGS. 11 and 12 show a third embodiment of the present invention. The third embodiment is similar to the second embodiment shown in FIGS. 8 through 10. So, parts which are similar to those of the second embodiment shown in FIGS. 8 through 10 are also denoted by the same reference numerals in FIGS. 11 and 12 showing the third embodiment. In the third embodiment, the trailing surface 36 formed on the trailing portion 30 of the guide plate 24 extends to the trailing edge 31 of the guide plate 24. Furthermore, the trailing portion 30 tapers in width or lateral dimension towards the trailing end 26 of the slider 1, thus presenting a wedge-like shape as a whole. This ensures that the sealing lips 11 can pass smoothly through the slider 1 during the movement of the slider 1, thereby mitigating frictional resistance caused by the sealing lips' sliding movement against the guide plate 24.

Conclusions, Ramifications, and Scope

As above stated, since the slider is integrally formed, the slider can be strengthened, and in particular in the region between the upper plate and the guide plate where the slider parts are subject to greater separation forces as the slider is pulled along the fastener to urge the sealing lips together. This substantially reduces the cost of the production process and also leads to an improvement in product quality because of the avoidance of any misalignment or other errors which may arise in an assembly process.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

What is claimed is:

1. A slider for guiding coupling elements and sealing lips of a fluid tight slide fastener, the slider having upper and lower plates joined together by a guide post and a guide plate formed on the guide post to cooperate with the upper and lower plates, the upper and lower plates have a forward end and a trailing end, wherein the upper and lower plates taper towards the trailing end, and wherein the slider is integrally formed and wherein further a forward portion of the guide plate proximate the forward end of the upper and lower plates having a thickened portion having a thickness is thickened relative to a trailing portion of the guide plate proximate the trailing end of the upper and lower plates and wherein further the thickened portion is spaced from each of the upper and lower plates along a direction parallel to a longitudinal length of the guide post, the thickened portion extends from a forward edge of the guide plate proximate the forward end of the upper and lower plates to a position near a trailing edge of the guide post and an outer edge of the thickened portion is chamfered wherein the chamfer is facing the upper plate.

2. A slider as claimed in claim 1, wherein the slider is die cast of metal.

3. A slider as claimed in claim 1, wherein the slider is moulded of plastics material.

4. A slider as claimed in claim 1, wherein a fillet is provided between an underside of the guide plate and the guide post.

5. A slider as claimed in claim 4, wherein the fillet extends from a trailing edge of the guide post.

6. A slider as claimed in claim 1, wherein a trailing portion of the guide plate, in a plane perpendicular to the lower plate, tapers away from the guide post towards a trailing edge of the guide plate.

7. A slider as claimed in claim 6, wherein the trailing portion of the guide plate ends in a nose.

8. A slider as claimed in claim 1, wherein a trailing portion of the upper plate has downwardly projecting guide flanges and an inner surface of the guide flange, at least at the trailing end of the slider, is formed at an angle to the upper plate to provide a mouth which tapers in the direction of the upper surface.

* * * * *